United States Patent [19]

Bergeron

[11] Patent Number: 5,067,342

[45] Date of Patent: Nov. 26, 1991

[54] SLIDING AND LOCKING SYSTEM FOR A FORCE APPLYING STRUCTURE ON A VEHICLE STRAIGHTENING BENCH

[76] Inventor: Marcel J. Bergeron, 288, Rang St-Edouard, Iberville, Quebec J2X 4J3, Canada

[21] Appl. No.: 519,660

[22] Filed: May 7, 1990

[51] Int. Cl.[5] ..... B21D 1/12

[52] U.S. Cl. ..... 72/447; 72/705

[58] Field of Search ..... 72/447, 457, 705

[56] References Cited

U.S. PATENT DOCUMENTS

| | | | |
|---|---|---|---|
| 4,138,876 | 2/1979 | Chism | 72/705 |
| 4,398,410 | 8/1983 | McWhorter et al. | 72/705 |
| 4,643,015 | 2/1987 | Larson et al. | 72/705 |
| 4,932,236 | 6/1990 | Hinson | 72/705 |

*Primary Examiner*—Lowell A. Larson

*Attorney, Agent, or Firm*—Roland L. Morneau

[57] ABSTRACT

A sliding and locking system is adapted to be mounted around a vehicle straightening bench for supporting a force applying structure. The sliding system includes a pair of spaced rollers adapted to ride on lateral flanges of a vehicle supporting beam, the wheels being mounted at the end of a transverse beam supporting the force applying structure. The transverse beam supports a locking system provided with lever arms adapted to tighten the truss beam on the transverse beam while releasing the roller from the truss beam. The truss beam is subdivided into two superposed transverse beams adapted to pivot relative to one another, one of which pivots relative to the truss beam.

8 Claims, 6 Drawing Sheets

10
11
W
P
J'

SLIDING AND LOCKING SYSTEM FOR A FORCE APPLYING STRUCTURE ON A VEHICLE STRAIGHTENING BENCH

BACKGROUND OF THE INVENTION

Field of the invention

Vehicle straightening benches usually have a force applying structure located on their periphery and are adapted to be moved therealong. Some force applying structures, such as in the present invention, are connected to the vehicle straightening bench and are provided with a system for sliding while being connected to the bench and with a system for locking the movement of this structure around the bench.

The present invention is particularly directed to a sliding and locking system for a force applying structure on a vehicle straightening bench having a generally rectangular pathway for supporting a vehicle. The sliding system makes use of rollers engaging a truss beam forming the Pathway. The sliding system is made of a transverse beam disposed crosswise under the pathway and extend outwardly to support the force applying structure. The transverse beam supports a locking system adapted to lock the truss beam against the transverse beam and remove the contact between the rollers and the truss beam.

In another embodiment, the force applying structure is supported by a pair of transverse beams, that is, a primary and secondary transverse beam. The two transverse beams are partly superposed under the truss beam, one of which is adapted to pivot relative to the truss beam so as to displace the force applying structure at an angular orientation relative to the truss beam.

Prior art

U.S. Pat. No. 4,313,335, to Leonard Eck makes use of a force applying structure adapted to be rotatably mounted around a work rack structure for correcting and aligning misshapened vehicle frame. Eck makes use of roller means for sliding the force applying structure wherein one set applies on the upper surface of the lower, external marginal ledge of the rack structure while the other rollers 101 and 102 contact the end surface 30 of the inner and lower flange 24 to provide a horizontal displacement of the force applying structure.

In the above-mentioned patent to Eck, the wheels used for moving the force applying structure are automatically brought out of rotatative engagement when a pulling force from the standard to the vehicle tends to swing the force applying structure upwardly, whereby the wheels become disengaged from the outer lower flange and a flange frictionally engages the upper surface of the inner portion of the upper planar member. This automatic system is achieved when the fluid ram pushes down the leverage arm 131 which, at the same time, pulls on the chain 135.

Furthermore, in U.S. Pat. No. 4,313,335, the pin 119 of the standard 16 is provided with a pivotal movement with the base 15 but the axis of the pin 119 is located on the outer periphery of the rack structure 2 and could not allow the force applying structure to move around a corner of a substantially rectangular rack structure and around one leg of a U-shape rack structure.

SUMMARY OF THE INVENTION

The invention is directed to a sliding and locking system adapted to support a force applying structure which is intended to move around a vehicle straightening bench. The sliding system is provided with roller means mounted to ride on an outer and an inner marginal ledge provided on the lower face of a truss beam forming a pathway for a vehicle straightening bench. The locking system is mounted on a transverse beam and provides a downward pressure for removing the contact between the roller means and the truss beam and for tightening the truss beam against the transverse beam so as to prevent movement of the transverse beam relative to the truss beam.

The locking system includes a pair of interconnected lever arms. One end of one arm is mounted to abut against the truss beam while one end of the other arm is provided with a wheel adapted to rotatably move on a sloping ramp so that the leverage action of both lever arms will provide the desired tightening action on the truss beam.

Another characteristic of the invention is directed to a pair of superposed transverse beam which can pivot one relative to the other, one of which relative the truss beam, so that the transverse beam supporting the force applying structure can rotate about a corner of a rectangular pathway of the vehicle straightening bench. Accordingly, the same force applying structure can be used to apply force along two orthogonal directions.

DETAILED DESCRIPTION OF THE INVENTION

Figure 1:
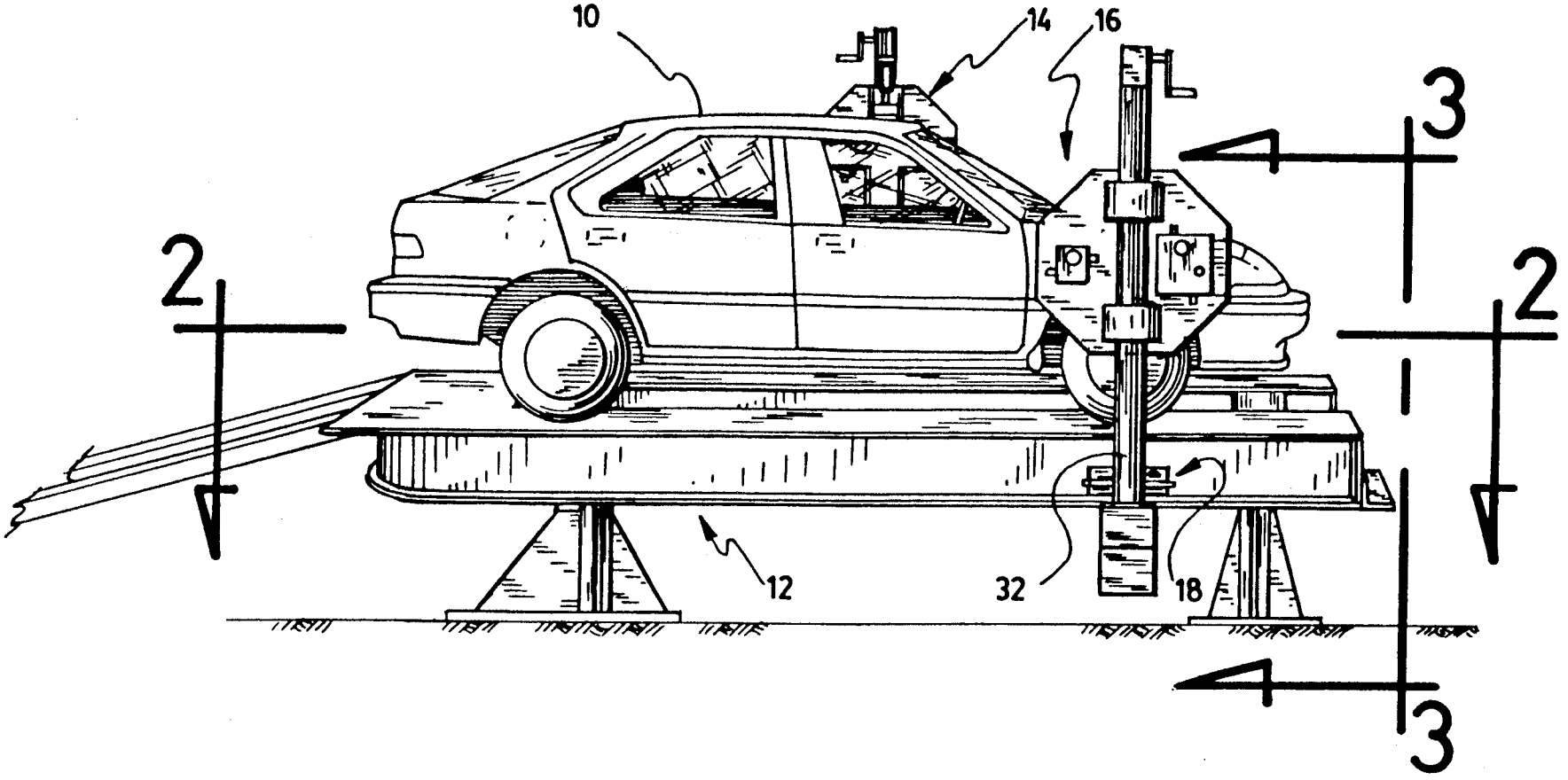
FIG. 1 is a side view of a vehicle straightening bench on which is mounted a vehicle and a pair of force applying structures, each supported by a sliding and locking system according to the invention.

FIG. 1 illustrates the general environment of the invention including a car 10 mounted on a straightening bench 12. Two force applying structures 14 and 16 are laterally mounted on the straightening bench 12 through a sliding and locking system 18. A patent application directed to the force applying structure of the type illustrated by figures 14 and 16 is simultaneously filed with the present application.

Figure 2:
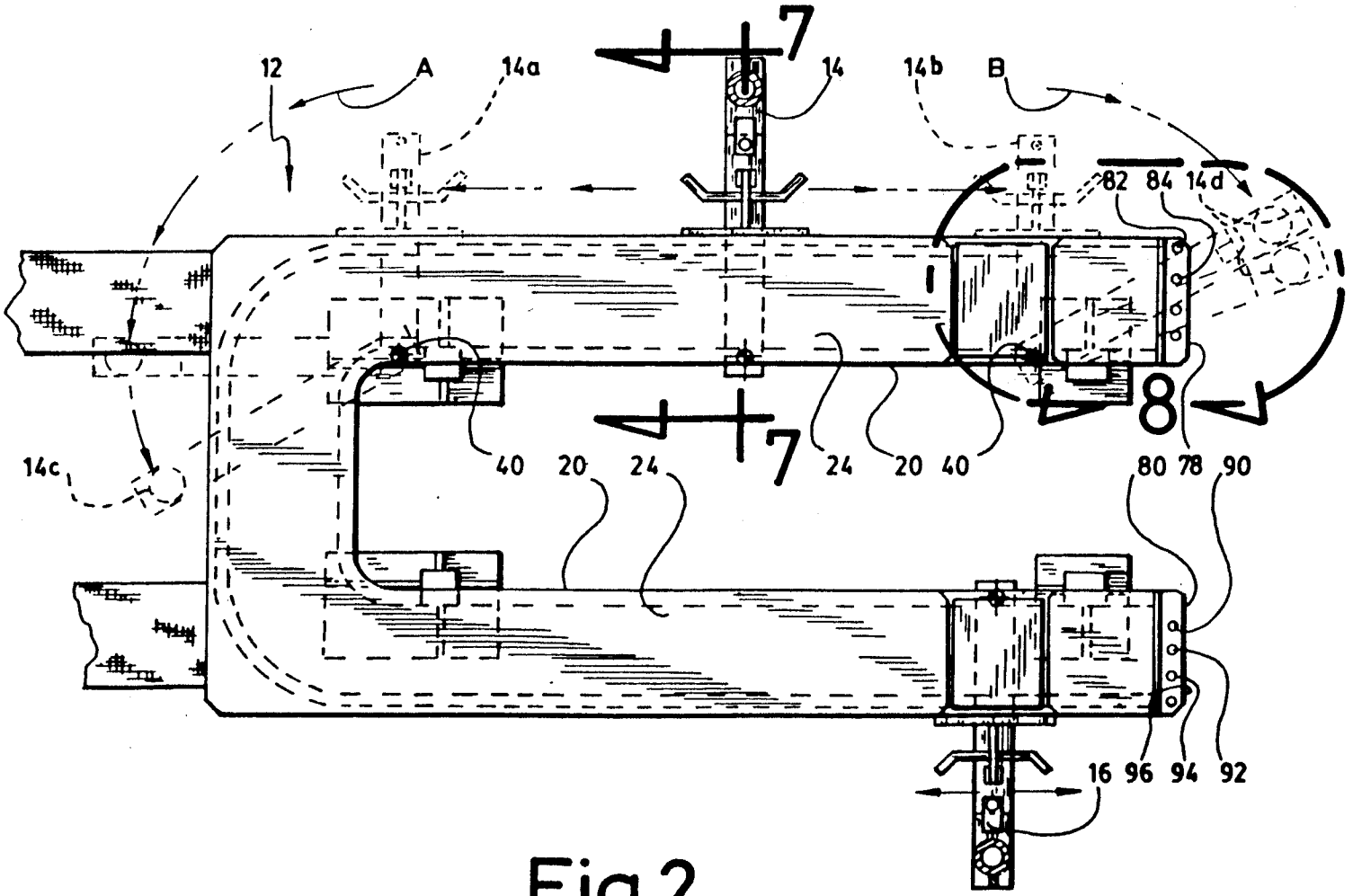
FIG. 2 is a top view along line 2—2 of FIG. 1.
Figure 3:
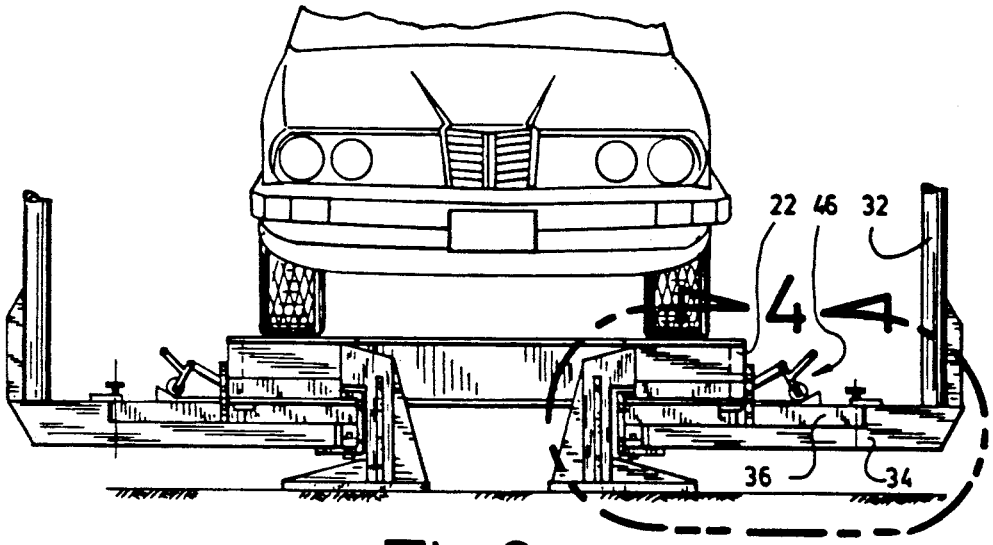
FIG. 3 is a front view along line 3—3 of FIG. 1.
Figure 4:
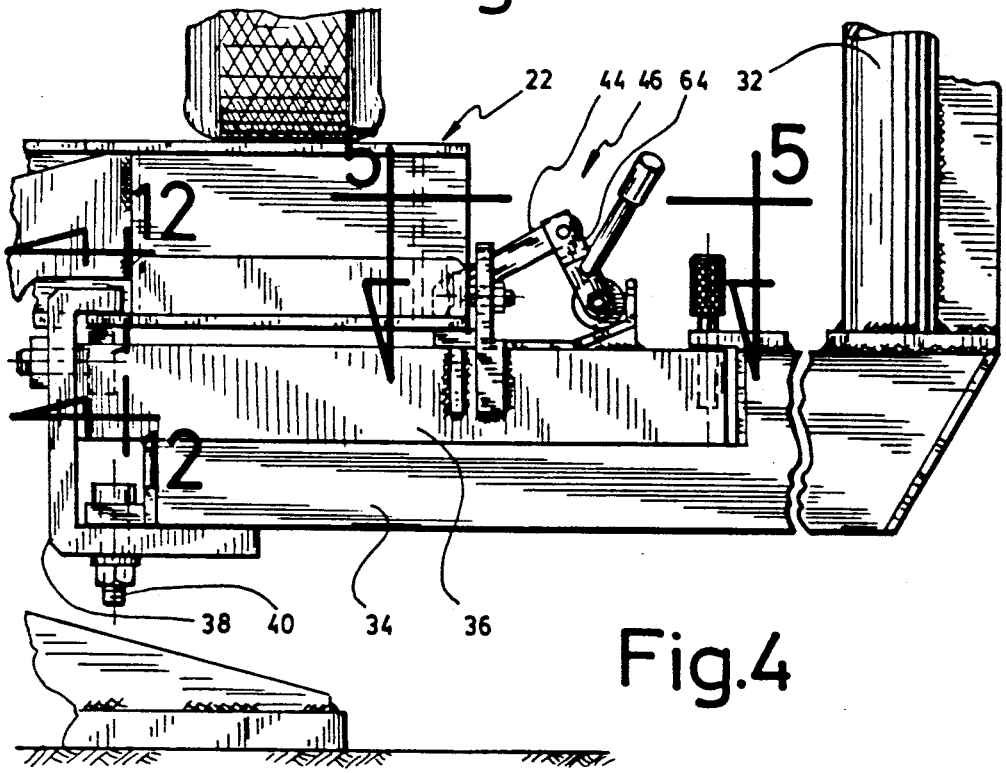
FIG. 4 is an enlarged view of the encircled portion 4 of FIG. 3 showing a side view of the sliding and locking system according to the invention.
Figure 5:
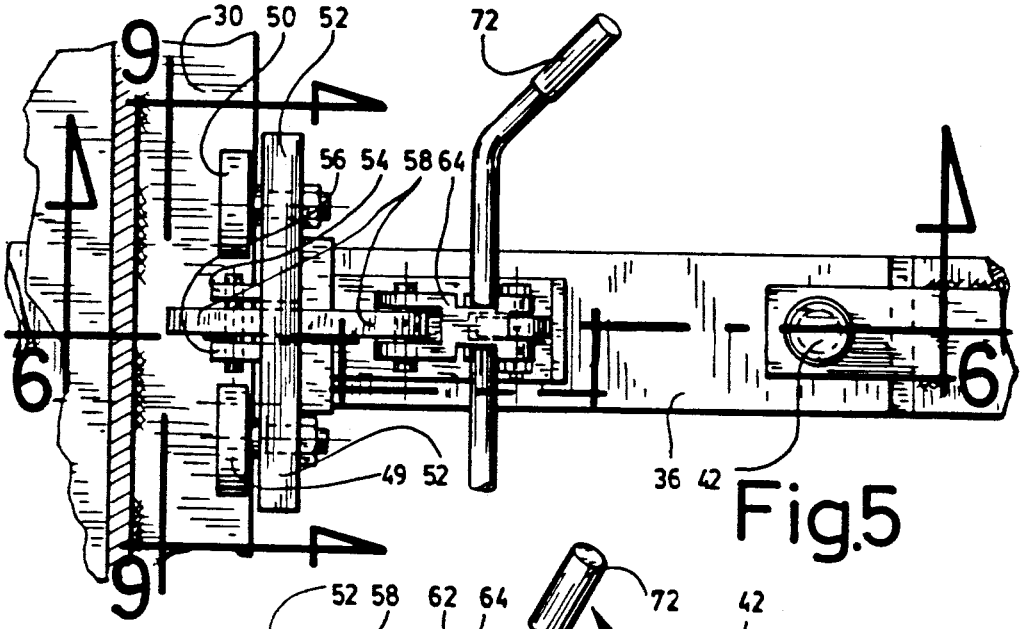
FIG. 5 is a top view along line 5—5 of FIG. 4.

FIG. 2 shows a top view of the vehicle straightening bench 12 comprising a U-shaped pathway 20 around which the force applying structures 14 and 16 are adapted to slide, as shown by reference 14*a* and 14*b* and adapted to pivot around the corners as shown by reference nos. 14*c* and 14*d*. The locking system is particularly defined in FIGS. 3–6, the sliding system in FIGS. 7, 9–12, and the pivoting system in FIGS. 7 and 8.

Figure 12:
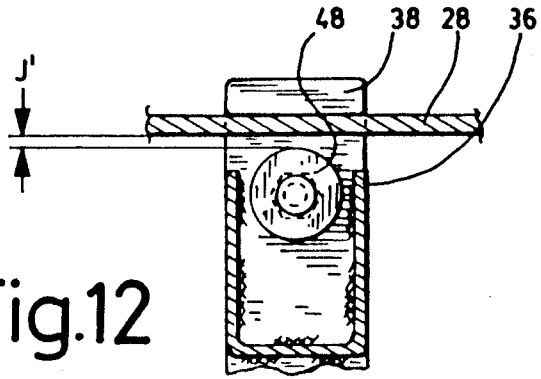
FIG. 12 is a cross-sectional view taken along line 12 of FIG. 4.

The pathway 20 is essentially made of a truss beam 22 having a car supporting surface 24. The lower surface 26 of the truss beam 22 has an inner marginal ledge 28 and an outer marginal ledge 30. A post 32 supporting the force applying structure 16 is connected to the truss beam 22 by a primary transverse beam 34 and a secondary transverse beam 36. The secondary transverse beam 36 is welded, as shown in FIG. 12, to a C-shape bracket 38 in a fixed relationship therewith and the primary transverse beam 34 is pivotally mounted to the C-shaped bracket 38 about an axle 40 located substantially below the inner marginal ledge 28. The relative rotation of both transverse beams is prevented by a retaining pin 42 adapted to be simultaneously inserted through both transverse beams 34 and 36.

Figure 6:
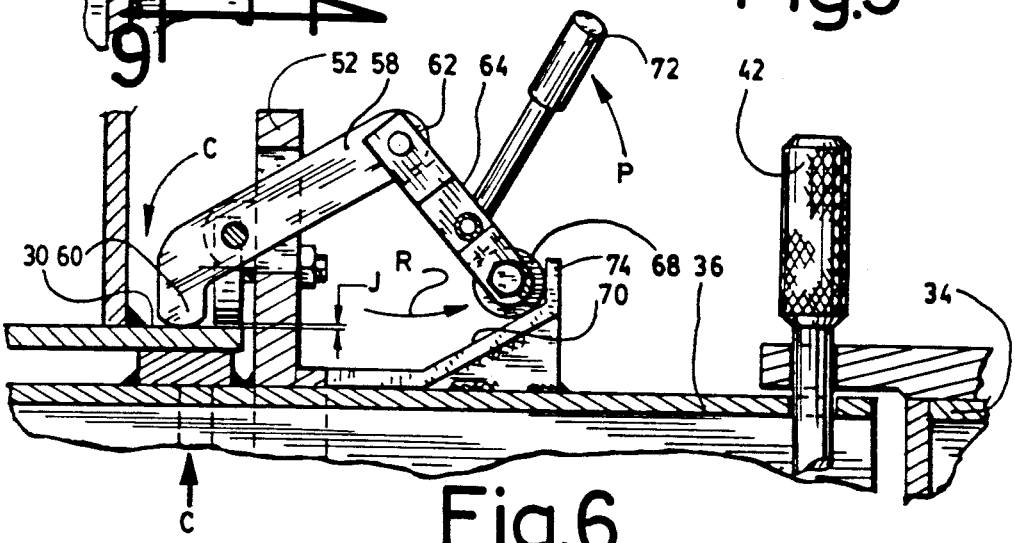
FIG. 6 is a partly cross-sectional view along line 6—6 of FIG. 5, showing the locking system.
Figure 6A:
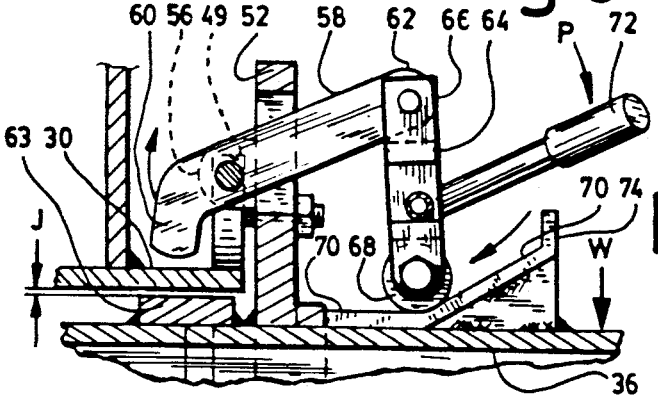
FIG. 6*a* is a view as shown in FIG. 6, in which the locking system is released.
Figures 7, 7A, 10, 11:
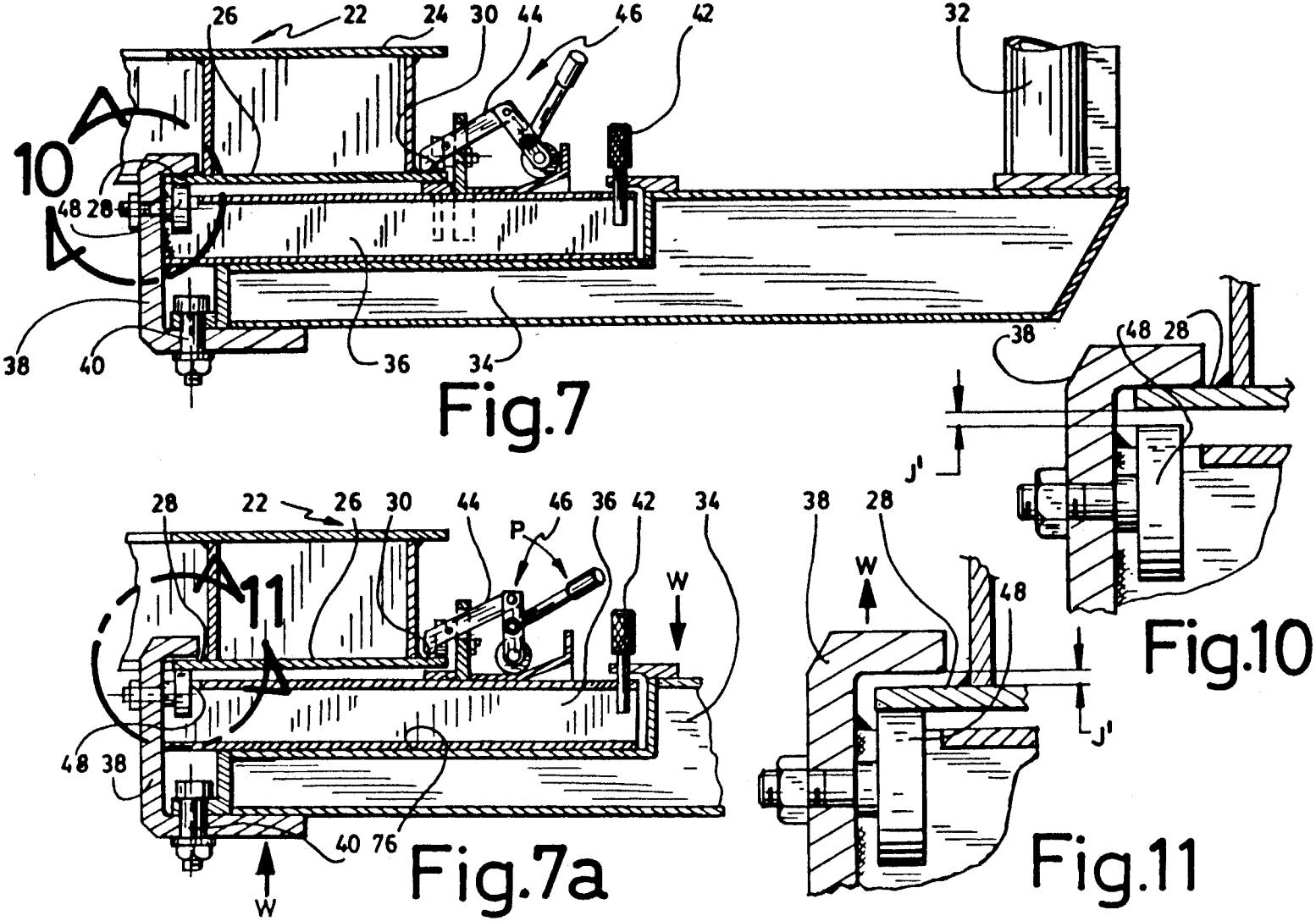
FIG. 7 is a cross-sectional view of the sliding and locking system taken along line 7—7 of FIG. 2.
FIG. 7*a* is a view as shown in FIG. 7 in which the locking system is released.
FIGS. 10 and 11 are enlarged view of encircled portions 10 and 11 of FIG. 7 and 7*a* respectively.
Figure 9:
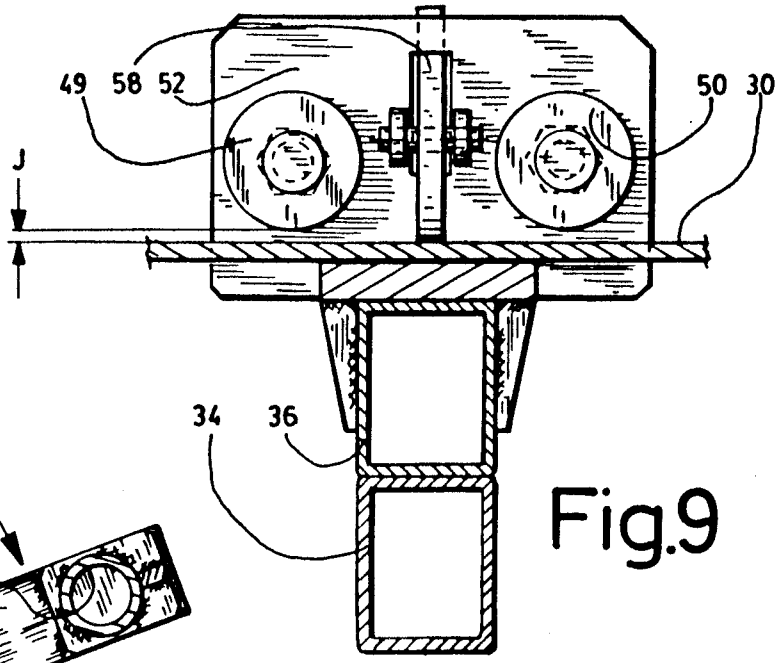
FIG. 9 is a view taken along line 9—9 of FIG. 5.
Figure 8:
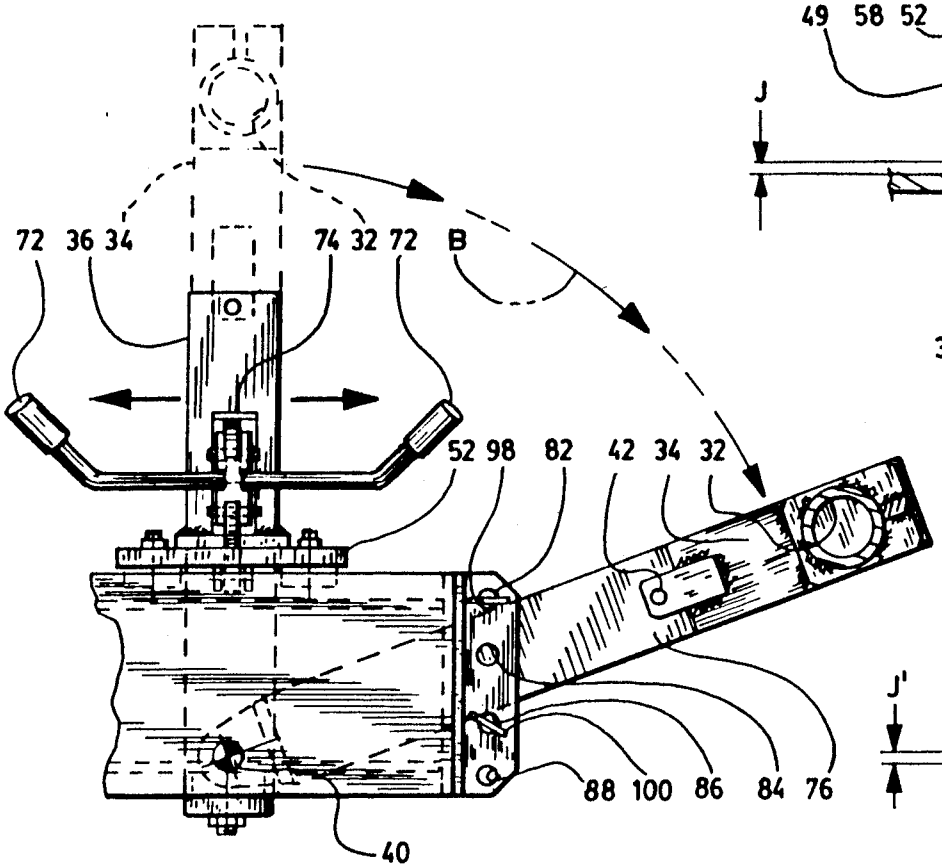
FIG. 8 is an enlarged view of the encircled portion 8 of FIG. 2.

In a stationery position, the upper part of the C-shaped bracket 38 is supported by the inner marginal ledge 28 and the lever 44 of a locking system 46 is adapted to be tightened over the outer marginal ledge 30. In order to obtain a longitudinal sliding movement of both transverse beams 34 and 36, the C-shape bracket 38 is provided with a roller 48 disposed under the inner marginal ledge 28 and a pair of rollers 49 and 50 located to ride on the upper surface of the outer marginal ledge 30. Both rollers 49 and 50 are rotatably mounted on a plate 52 secured to the secondary transverse beam 36. When the lever 44 of the locking system 46 does not apply any pressure on the outer marginal ledge 30, the weight of the force applying structure on the post 32, produces a clockwise torque on the transverse beams as shown by both arrows W in FIG. 7*a*. The upper end of the C-shaped bracket 38 raises away from the inner marginal ledge 28 while the roller 48 comes in contact with the latter. Simultaneously, the rollers 49 and 50 come in contact with the outer marginal ledge 30 in the position, as shown in FIG. 7*a*. The transverse beams 34 and 36 become supported by rollers 48, 49 and 50 and can be slidingly moved around the pathway 20. As particularly shown in FIGS. 10 and 11, the ledge 28 is spaced from the upper part of the C-shaped bracket 38 and the roller 48 respectively by a distance J' which corresponds to the distance between the roller 48 and the ledge 28 in FIGS. 7, 11 and 10 and between the C-shaped bracket 38 and the ledge 28 in FIGS. 7*a* and 12. The spacing J' is reflected by a substantially similar spacing J between the rollers 49 and 50 and the outer marginal ledge 30. The rollers 49 and 50 act as fulcrum between the roller 48 and the post 32. As indicated above, the locking system 46 is adapted to remove the contact between the truss beam 22 and the rollers 48, 49 and 50. Such a locking system is generally shown in the front view of FIG. 3 and more specifically illustrated in the enlarged portion of FIG. 4. The structure and the operation of the locking system can be more clearly described by referring to FIGS. 5, 6 and 6*a*. The plate 52 which pivotally supports the rollers 49 and 50 (FIG. 9) is provided with a pair of lugs 54 and 56 adapted to pivotally support a first lever 58. One end 60 of the first lever 58 is adapted to frictionally abut against the ledge 30 in order to lower the latter by a distance J (FIG. 6*a*) so that the ledge 28 loses contact with the roller 48 and frictionally abuts against s metal strip 62 welded to the top surface of the transverse beam 36. The other end 62 of the lever 58 is pivotally connected to a second lever 64 at one end 66. The other end of the lever 64 is provided with a wheel 68 adapted to move along a sloping ramp 70 by actuating a handle 72. The ramp 70 is located adjacent the plate 52 and is generally tilted in the direction of the latter. The tilt and the location of the ramp 70 is predetermined so that the rotation of the wheel 68 over the ramp 70 will pivot the first lever 58 and lock the latter in the position illustrated in FIG. 6. In FIG. 6*a*, the wheel 68 is at the lower end of the ramp and similarly the end 62 of the lever 58 is at its lowest position so that the end 60 of the lever 58 is out of contact with the ledge 30. When the handle 72 is pulled upwardly in the direction of the arrow P in FIG. 6, the wheel 68 moves up the sloping ramp 70 in the direction of the arrow R. This movement raises the end 62 of the lever 68 and lowers the end 60 in frictional abuttment against the ledge 30. When the wheel 68 has reached the vertical portion 74 of the ramp 70, the lever 58 is locked in the position shown in FIG. 6. In this position, both transverse beams 34 and 36 are locked against the truss beam 22 and immobilizes the force applying structure in a fixed position relative to the pathway 20. When the locking system 46 is released, that is, when the handle 72 is lowered as in FIG. 6*a*, the weight of the truss beams 34 and 36 and of the force applying structure 16 applies a weight W along the arrow shown in FIG. 6*a* and raises the ledge 30 in contact with the rollers 49 and 50. Similarly, the roller 48 comes in contact with the lower surface of the ledge 28.

The force applying structure 14, as shown in FIG. 2, is essentially moving sideways along the legs of the U-shaped pathway 20. In this orthogonal position, the force applying structure 14 can perform corrections on the side of misshapened vehicles such as corrections after a wheel alignment measurement but corrections may also be needed while facing the front or the rear of the vehicle. For this purpose, the present invention is additionally characterized by a transverse beam divided as a primary and a secondary transverse beams 34 and 36. The primary transverse beam 34 has a recess 76 in its upper surface located below the truss beam 22 and extending over a portion outwardly adjacent the truss beam 22. The lower surface of the transverse beam 36 rests in the recess 76 but when the locking system 46 is in a position such as shown in FIG. 6, this releases the pressure between both transverse beams 34 and 36 and facilitates the relative sliding of both of the latter beams. When the primary transverse beam 34 needs to be pivoted relative to the secondary beam 36 about the axle 40, as shown in FIG. 2, the lever 44 is locked on the ledge 30 of the truss beam 22 and the pin 42 is removed from its socket. The secondary transverse beam 36 being welded to the C-shaped bracket 38, it will remain stationery relative to the truss beam 22 considering that the upper portion of the C-shaped bracket 38 rests on the outer ledge 28. The primary transverse beam 34 can be manually pushed around the axle 40 along arrows A or B to reach a position such as shown by 14*c* or 14*d* in FIG. 2. When the primary truss beam 34 has reached a position such as shown by 14*c* and 14*d* which allows a frontal or rearward pulling and pushing action, it is useful that the force applying structure 16 be secured in a definite position. For this Purpose, the ends 78 and 80 of the legs of the U-shaped pathway 20 are provided with apertures 82, 84, 86 and 88 and locating pins 98 and 100 adapted to be inserted in two of the apertures 82–88 (see FIG. 8). The distance between two of the apertures 82–88 are adapted to correspond to the width of the primary transversal beam 84 so that the locating pins are inserted on each side of the beam 34. The latter is consequently secured between a pair of pins while being pivotable about the axle 40. The same applies to the end 80 of the pathway 20 which has apertures 90, 92, 94 and 96 (FIG. 2) adapted to receive similar locating pins.

Although two transverse beams have been described in order to obtain a pivotal action around corners of the pathway, only one combined transverse beam is necessary for the sliding and the locking system perse.

I claim:

1. A sliding and locking system for a force applying structure on a vehicle straightening bench having a generally rectangular pathway for supporting a vehicle, said pathway being characterized by a truss beam having a rectangular cross-section with a lower face having an outer and an inner marginal ledge, said system comprising:

a primary transverse beam disposed crosswise under said pathway and extending outwardly from said pathway for supporting said force applying structure, said primary transverse beam being vertically spaced from the lower face of said pathway;

first roller means rotatably fixed to said primary transverse beam adapted to support said transverse beam on the upper surface of the outer marginal ledge, and act as a fulcrum for said transverse beam;

second roller means rotatably fixed to said primary transverse beam adapted to contact the lower surface of the inner marginal ledge upon leverage action of the transvers beam around said fulcrum, said first and second roller means allowing said primary transverse beam to rotatably slide along said pathway;

locking means secured on the primary transverse beam adapted to exert a downward pressure on the upper surface of said outer marginal ledge for producing a reverse action to said leverage action and tightening said outer marginal ledge on said primary transverse beam.

2. A sliding and locking system as recited in claim 1, wherein said locking system comprises a plate member secured on said primary transverse beam adjacent said outer ledge, a first lever pivotally mounted on said plate member, said first lever having one end adapted to releasably apply a downward pressure on the upper surface of said outer ledge and another end extending upwardly, a second lever pivotally connected at one end to said second end of the first lever, said second lever having a second end provided with a rotatable wheel, a sloping ramp secured on said primary transverse beam for guiding said wheel, and a handle member secured to said second lever for moving said wheel on said sloping ramp, whereby the displacement of said wheel along said ramp pivots said first and second levers to lock said one end of said first lever against the upper surface of said outer ledge.

3. A sliding and locking system as recited in claim 2, wherein said first level is pivotally positioned adjacent said first roller means.

4. A sliding and locking system for a force applying structure on a vehicle straightening bench having a generally rectangular pathway for supporting a vehicle, said pathway being characterized by a truss beam having a rectangular cross-section with a lower face having an outer and an inner marginal ledge, said system compromising a primary transverse beam disposed crosswise under said pathway and extending outwardly from said pathway for supporting said force applying structure, said primary transverse beam being provided with a recess below said truss beam, said recess extending over a portion outwardly adjacent said truss beam, a secondary transverse beam located in said recess and compromising a lateral portion projecting below and outwardly of said truss beam, said secondary transverse beam being angularly fixed relative to said truss beam, means for pivoting said primary transverse beam about a vertical axis below said inner marginal edge, retaining means for realeasably fixing the secondary transverse beam to said primary transverse beam while in said recess, whereby said primary transverse beam is adapted to be angularly displaced relative to the truss beam and relative to the secondary transverse beam when the retaining means is released.

5. A sliding and locking system for as recited in claim 4, comprising a first roller means rotatably fixed to said secondary transverse beam adapted to support both primary and secondary transverse beams on the upper surface of the outer marginal ledge and act as a fulcrum for both transverse beams, second roller means rotatably fixed to said primary transverse beam adapted to contact the lower surface of the inner marginal ledge upon a leverage action of both transverse beams around said fulcrum , said first and second roller means allowing both of said transverse beams to rotatably slide along said pathway.

6. A sliding and locking system as recited in claim 5, comprising locking means secured on the secondary transverse beam adapted to exert a downward pressure on the upper surface of the outer marginal ledge which is slightly spaced from said secondary transverse beam, said downward pressure adapted to abut said outer marginal ledge against said secondary transverse beam while distancing both of said roller means from both of said marginal ledges.

7. A sliding and locking system as recited in claim 6, wherein said locking means comprises a plate member secured on said secondary transverse beam adjacent said outer ledge, a first lever pivotally mounted on said plate member, said first lever having one end adapted to releasably apply a downward pressure on the upper surface of said outer ledge and another end extending upwardly, a second lever pivotally connected at one end to said second end of the first lever, said second lever having a second end provided with a rotatable wheel, a sloping ramp secured on said secondary transverse beam for guiding said wheel, and a handle member secured to said second lever for moving said wheel on said sloping ramp, whereby the displacement of said wheel along said ramp pivots said first and second levers to lock said one end of said first lever against the upper surface of said outer ledge.

8. A sliding and locking system as recited in claim 7, wherein the pathway has a U-shape displaying two unconnected leg members each having an end surface, each of said end surfaces is provided with laterally spaced apertures adapted to receive locking pins whereby, when said primary transverse beam is pivoted relative said secondary transverse beam to cross one of said end surfaces, said locking pins are inserted in said apertures for laterally abutting said primary transverse beam.

* * * * *